US011175600B2

(12) United States Patent
Uchiyama et al.

(10) Patent No.: US 11,175,600 B2
(45) Date of Patent: Nov. 16, 2021

(54) TONER

(71) Applicant: CANON KABUSHIKI KAISHA, Tokyo (JP)

(72) Inventors: Akihiko Uchiyama, Mishima (JP); Tetsuya Sano, Mishima (JP); Tomoaki Nakai, Numazu (JP); Takashi Kenmoku, Mishima (JP); Kenta Kamikura, Yokohama (JP); Yuzo Seino, Gotemba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/935,259

(22) Filed: Jul. 22, 2020

(65) Prior Publication Data

US 2021/0026263 A1 Jan. 28, 2021

(30) Foreign Application Priority Data

Jul. 25, 2019 (JP) ..... JP2019-137198

(51) Int. Cl.
*G03G 9/08* (2006.01)
*G03G 9/097* (2006.01)
*G03G 9/087* (2006.01)

(52) U.S. Cl.
CPC ..... *G03G 9/0823* (2013.01); *G03G 9/08711* (2013.01); *G03G 9/08773* (2013.01); *G03G 9/09708* (2013.01)

(58) Field of Classification Search
CPC ..... G03G 9/0823
USPC ..... 430/111.41
See application file for complete search history.

(56) References Cited

U.S. PATENT DOCUMENTS

| | | | |
|---|---|---|---|
| 6,777,153 | B2 | 8/2004 | Yano et al. |
| 6,808,907 | B2 | 10/2004 | Honma et al. |
| 6,908,721 | B2 | 6/2005 | Kenmoku et al. |
| 6,911,520 | B2 | 6/2005 | Fukui et al. |
| 7,045,321 | B2 | 5/2006 | Imamura et al. |
| 7,393,912 | B2 | 7/2008 | Mihara et al. |
| 7,399,568 | B2 | 7/2008 | Fukui et al. |
| 7,408,017 | B2 | 8/2008 | Imamura et al. |
| 7,452,960 | B2 | 11/2008 | Yano et al. |
| 7,510,813 | B2 | 3/2009 | Yano et al. |
| 7,638,194 | B2 | 12/2009 | Fukui et al. |
| 7,638,590 | B2 | 12/2009 | Fukui et al. |
| 7,682,765 | B2 | 3/2010 | Sugawa et al. |
| 7,795,363 | B2 | 9/2010 | Fukui et al. |
| 7,935,771 | B2 | 5/2011 | Fukui et al. |

(Continued)

FOREIGN PATENT DOCUMENTS

JP 2005-272022 10/2005

OTHER PUBLICATIONS

U.S. Appl. No. 16/935,254, Takashi Kenmoku, filed Jul. 22, 2020.

(Continued)

*Primary Examiner* — Mark A Chapman
(74) *Attorney, Agent, or Firm* — Venable LLP

(57) ABSTRACT

A toner comprising a toner particle, wherein the toner particle includes a binder resin, where a volume resistivity Ω·cm of an unfixed solid image on a recording material on which the solid image has been formed using the toner at a toner laid-on level of 0.4 mg/cm$^2$ is denoted by Tv, and a volume resistivity Ω·cm of the solid image after fixing by applying heat and pressure to the recording material is denoted by Fv, Tv/Fv≥8 is satisfied.

7 Claims, 5 Drawing Sheets

(56) References Cited

U.S. PATENT DOCUMENTS

| | | | |
|---|---|---|---|
| 8,067,136 | B2 | 11/2011 | Yano et al. |
| 8,093,342 | B2 | 1/2012 | Minami et al. |
| 8,110,329 | B2 | 2/2012 | Tominaga et al. |
| 8,178,271 | B2 | 5/2012 | Fukui et al. |
| 8,383,312 | B2 | 2/2013 | Fujimoto et al. |
| 8,574,801 | B2 | 11/2013 | Itabashi et al. |
| 8,609,312 | B2 | 12/2013 | Itabashi et al. |
| 8,828,633 | B2 | 9/2014 | Itabashi et al. |
| 8,828,639 | B2 | 9/2014 | Kamikura et al. |
| 9,029,056 | B2 | 5/2015 | Kenmoku et al. |
| 9,098,002 | B2 | 8/2015 | Kenmoku et al. |
| 9,098,003 | B2 | 8/2015 | Masumoto et al. |
| 9,158,216 | B2 | 10/2015 | Shimano et al. |
| 9,377,705 | B2 | 6/2016 | Shimano et al. |
| 9,383,668 | B2 | 7/2016 | Noji et al. |
| 9,423,708 | B2 | 8/2016 | Tominaga et al. |
| 9,423,714 | B2 | 8/2016 | Kenmoku et al. |
| 9,575,424 | B2 | 2/2017 | Nakagawa et al. |
| 9,599,919 | B2 | 3/2017 | Isono et al. |
| 9,658,554 | B2 | 5/2017 | Kinumatsu et al. |
| 9,720,340 | B2 | 8/2017 | Tominaga et al. |
| 9,733,584 | B2 | 8/2017 | Masumoto et al. |
| 9,785,071 | B2 | 10/2017 | Shimano et al. |
| 9,798,256 | B2 | 10/2017 | Kosaki et al. |
| 9,798,262 | B2 | 10/2017 | Toyoizumi et al. |
| 9,811,016 | B2 | 11/2017 | Aoki et al. |
| 9,823,595 | B2 | 11/2017 | Toyoizumi et al. |
| 9,829,814 | B2 | 11/2017 | Yoshida et al. |
| 9,829,816 | B2 | 11/2017 | Tanaka et al. |
| 9,829,820 | B2 | 11/2017 | Masumoto et al. |
| 9,835,964 | B2 | 12/2017 | Yoshida et al. |
| 9,857,711 | B2 | 1/2018 | Yoshida et al. |
| 9,857,713 | B2 | 1/2018 | Kosaki et al. |
| 9,869,943 | B2 | 1/2018 | Aoki et al. |
| 9,880,478 | B2 | 1/2018 | Shimano et al. |
| 9,897,932 | B2 | 2/2018 | Hotta et al. |
| 9,897,933 | B2 | 2/2018 | Yoshida et al. |
| 9,952,523 | B2 | 4/2018 | Shimano et al. |
| 9,964,879 | B2 | 5/2018 | Terui et al. |
| 10,012,922 | B2 | 7/2018 | Yoshida et al. |
| 10,078,285 | B2 | 9/2018 | Kubo et al. |
| 10,114,303 | B2 | 10/2018 | Katsura et al. |
| 10,295,920 | B2 | 5/2019 | Nishikawa et al. |
| 10,295,922 | B2 | 5/2019 | Terui et al. |
| 10,303,074 | B2 | 5/2019 | Yamawaki et al. |
| 10,303,075 | B2 | 5/2019 | Tanaka et al. |
| 10,310,396 | B2 | 6/2019 | Kamikura et al. |
| 10,338,487 | B2 | 7/2019 | Kamikura et al. |
| 10,345,726 | B2 | 7/2019 | Nakamura et al. |
| 10,353,308 | B2 | 7/2019 | Hatakeyama et al. |
| 10,401,750 | B2 | 9/2019 | Nakamura et al. |
| 10,409,180 | B2 | 9/2019 | Koji et al. |
| 10,429,757 | B2 | 10/2019 | Yoshida et al. |
| 10,503,090 | B2 | 12/2019 | Tominaga et al. |
| 10,539,893 | B2 | 1/2020 | Tanaka et al. |
| 10,539,899 | B2 | 1/2020 | Nakamura et al. |
| 10,545,422 | B2 | 1/2020 | Yamawaki et al. |
| 10,551,758 | B2 | 2/2020 | Tanaka et al. |
| 10,635,010 | B2 | 4/2020 | Kamikura et al. |
| 10,732,530 | B2 | 8/2020 | Matsui et al. |
| 10,747,136 | B2 | 8/2020 | Kenmoku et al. |
| 2005/0054063 | A1 | 3/2005 | Honma et al. |
| 2005/0260514 | A1 | 11/2005 | Mihara et al. |
| 2006/0194071 | A1 | 8/2006 | Yano et al. |
| 2007/0117945 | A1 | 5/2007 | Minami et al. |
| 2007/0275317 | A1 | 11/2007 | Fujimoto et al. |
| 2010/0121023 | A1 | 5/2010 | Fukui et al. |
| 2012/0172562 | A1 | 7/2012 | Kenmoku et al. |
| 2013/0065174 | A1 | 3/2013 | Itabashi et al. |
| 2019/0271926 | A1 | 9/2019 | Kamikura et al. |
| 2019/0384197 | A1 | 12/2019 | Aoki et al. |
| 2019/0384200 | A1 | 12/2019 | Kamikura et al. |
| 2020/0356019 | A1 | 11/2020 | Matsui et al. |

OTHER PUBLICATIONS

U.S. Appl. No. 16/935,263, Kenta Kamikura, filed Jul. 22, 2020.
U.S. Appl. No. 16/935,268, Noritaka Toyoizumi, filed Jul. 22, 2020.
U.S. Appl. No. 16/935,271, Kenta Kamikura, filed Jul. 22, 2020.
U.S. Appl. No. 16/934,159, Harunobu Ogaki, filed Jul. 21, 2020.

Density-measuring Position of Image on Second Side

Image on Second Side
Actually Obtained

TONER

BACKGROUND OF THE INVENTION

Field of the Invention

The present disclosure relates to a toner for use in an electrophotographic image forming apparatus.

Description of the Related Art

For example, in the electrophotographic image forming apparatus described in Japanese Patent Application Publication No. 2005-272022, a double-sided image can be obtained by transferring and fixing a toner image on one side of a recording material and then switching back the recording material and forming a toner image on the other side of the recording material.

SUMMARY OF THE INVENTION

For example, where an image having a region 401 on which a toner is laid and a region 402 on which the toner is not laid, as shown in FIG. 4A, is formed on one side (first side) of a recording material, since a generally used toner has a high electric resistance, the region 401 of the recording material on which the toner is laid has a higher electric resistance than the region 402 on which the toner is not laid.

Where an image like that shown in FIG. 4B is to be transferred to the other side (second side) of this recording material in this state, a transfer voltage is set such that the image on the second side could be adequately transferred also to the region 401 which has a high resistance due to the toner of the first side. Therefore, the transfer voltage becomes excessive in the region of the second side corresponding to the low-resistance region 402 of the first side.

Where the transfer voltage is excessive, a phenomenon called "penetration" occurs in which the transfer current flows without the movement of the toner, and although the image on the second side should essentially look like that in FIG. 4B, the portion corresponding to the image on the first side becomes thin as shown in FIG. 4C. In addition, since the recording material with the image on the first side is switched back and fed to form an image on the second side, the position corresponding to the image on the first side is vertically reversed on the second side.

In view of the above problems, the present disclosure provides a toner that makes it possible to obtain an image which is free of transfer defects on the second side, without being affected by the image on the first side, in an image forming apparatus capable of printing on both sides of a recording material.

A toner comprising a toner particle, wherein the toner particle includes a binder resin, where a volume resistivity Ω·cm of an unfixed solid image on a recording material on which the solid image has been formed using the toner at a toner laid-on level of 0.4 $mg/cm^2$ is denoted by Tv, and a volume resistivity Ω·cm of the solid image after fixing by applying heat and pressure to the recording material is denoted by Fv, a following condition is satisfied:

$$Tv/Fv \geq 8.$$

According to the present disclosure, it is possible to provide a toner capable of adequately forming an image on the second side, without being affected by an image on the first side, in an image forming apparatus capable of printing on both sides of a recording material.

Further features of the present invention will become apparent from the following description of exemplary embodiments with reference to the attached drawings.

DESCRIPTION OF THE EMBODIMENTS

Unless otherwise specified, the description of "from XX to YY" or "XX to YY" representing a numerical range means a numerical range including a lower limit and an upper limit which are endpoints.

An image forming apparatus will be described below with reference to the drawings. The following does not limit the invention as in the claims, and all combinations of the features described below are not necessarily essential to the means for solving the problem.

Configuration and Operation of Image Forming Apparatus

Figure 1:
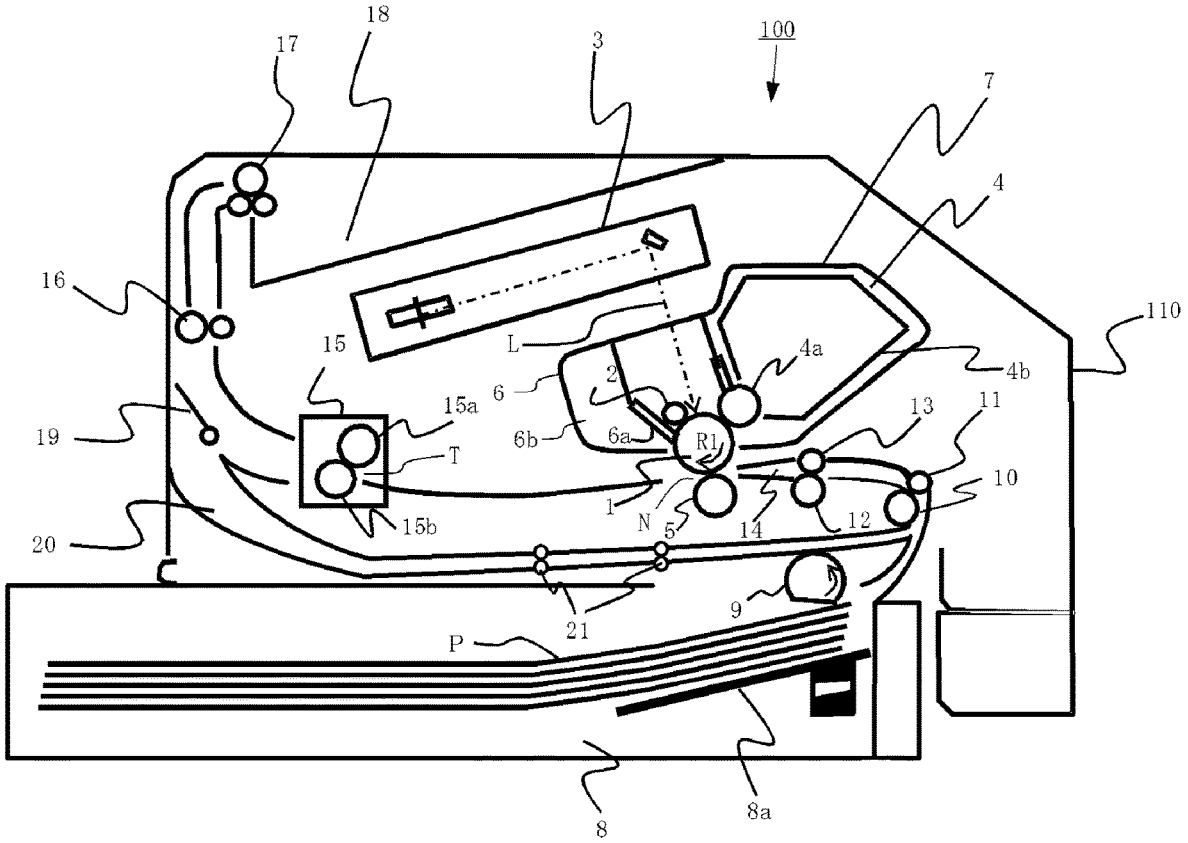
FIG. 1 is a schematic configuration diagram of an image forming apparatus.

FIG. 1 is a schematic sectional view of an image forming apparatus 100 as an example of an electrophotographic image forming apparatus using a toner. The image forming apparatus 100 forms an image according to image information input from an external device (not shown) such as a host computer on a recording material P.

The image forming apparatus 100 has a photosensitive drum 1 which is a drum type (cylindrical) electrophotographic photosensitive member as an image bearing member. Where a print command is inputted from an external device, the photosensitive drum 1 is rotationally driven at a predetermined speed (process speed) in the direction of arrow R1 in the figure. For example, as the photosensitive drum 1, it is possible to use one formed by applying an organic photoconductor layer (OPC photosensitive member) to the outer peripheral surface of an aluminum cylinder having a diameter of 30 mm.

Further, the photosensitive drum 1 is rotatably supported at both ends thereof in a longitudinal direction (rotational axis direction) by a support member and is rotationally driven by a driving force from a driving motor (not shown) as a driving means which is transmitted to one end thereof. For example, the charging polarity of the photosensitive drum 1 is negative.

The outer peripheral surface (surface) of the rotating photosensitive drum 1 is uniformly charged to a predetermined potential of a predetermined polarity by a charging roller 2 which is a roller-shaped charging member as a charging means. The charging roller 2 is constituted by a conductive roller, disposed in contact with the surface of the photosensitive drum 1, and urged (pressed) toward the photosensitive drum 1 with a predetermined pressure. The charging roller 2 is driven to rotate following the rotation of the photosensitive drum 1. Further, a predetermined charging voltage (charging bias) of negative polarity is applied to the charging roller 2 from a charging power source (high-voltage power source) (not shown), and the photosensitive drum 1 is charged to a predetermined potential Vd.

Image information is written on the charged surface of the photosensitive drum 1 by an exposure device (laser scanner) 3 which is an exposure means constituted by a scanner unit for scanning the surface with light emitted from a laser by a polygon mirror. The exposure device 3 outputs a laser beam L modulated according to a time-series electric digital pixel signal of image information inputted to the image forming apparatus 100 from the external device.

The exposure device 3 selectively scans and exposes the surface of the charged photosensitive drum 1 with the laser light L. As a result, the absolute value of the electric potential of the exposed portion (image portion) of the photosensitive drum 1 decreases to a bright portion potential V1, and an electrostatic latent image (electrostatic image) corresponding to image information is formed on the photosensitive drum 1. The exposure device 3 as an exposure unit is an example of an image forming means for forming an electrostatic image on the photosensitive drum 1 charged by the charging means.

The electrostatic latent image formed on the photosensitive drum 1 is developed (visualized) as a toner image by a developing device 4 as a developing unit by using a toner as a developer. The developing device 4 includes a developing roller 4*a* as a developer bearing member, and a developing container 4*b* that stores the toner to be supplied to the developing roller 4*a*.

For example, the developing roller 4*a* can be configured by coating a roller surface having a diameter of 20 mm and made of a metal with a polymer elastic material such as ethylene-propylene-diene terpolymer (EPDM). A predetermined DC developing voltage (developing bias) is applied to the developing roller 4*a* from a developing power source (high-voltage power source) (not shown). The toner supplied from the developing container 4*b* to the developing roller 4*a* is caused to selectively adhere to the surface of the photosensitive drum 1 according to the pattern of the electrostatic latent image by an electric field formed between the developing roller 4*a* and the photosensitive drum 1 at a developing position where the developing roller 4*a* and the photosensitive drum 1 face each other.

For example, the toner charged to the same polarity as the charging polarity of the photosensitive drum 1 adheres to the exposed portion on the photosensitive drum 1 where the absolute value of the potential has been reduced by exposure after the uniform charging treatment, and a toner image is formed (reverse development).

A transfer roller 5, which is a roller-shaped transfer member serving as a transfer unit, is arranged to face the photosensitive drum 1. The transfer roller 5 is arranged in contact with the surface of the photosensitive drum 1, and is urged (pressed) toward the photosensitive drum 1 with a predetermined pressure. As a result, a transfer portion N, which is a nip portion (transfer nip), is formed between the surface of the photosensitive drum 1 and the outer peripheral surface (front surface) of the transfer roller 5.

For example, the transfer roller 5 can be a conductive roller that has a conductive elastic body (NBR hydrin rubber) having an electric resistance of about from $10^6$ to $10^9\Omega$ and provided around a shaft having an outer diameter of 6 mm and made of a metal such as stainless steel so as to obtain an outer diameter of 17 mm.

Figure 2:
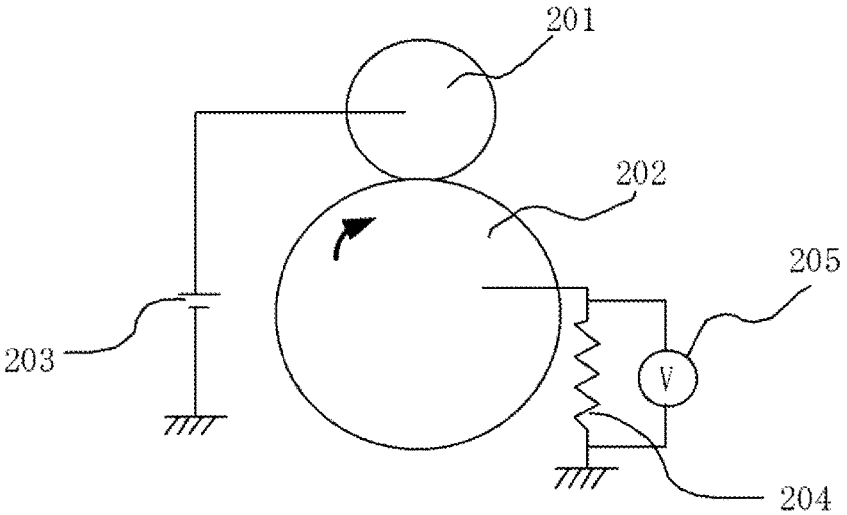
FIG. 2 is a diagram explaining how to measure the electric resistance of a roller member.

Note that the resistance value R is measured by a method such as shown in FIG. 2 under the environment of 23° C. and 50% RH. That is, the roller 201 to be measured is brought into contact with a ϕ30 aluminum cylinder 202 at a total pressure of 9.8 N (1 kgf) and rotated at 30 rpm, and a current when the voltage of 1000 V is applied from the power source 203 is measured. The current is obtained by measuring the terminal voltage Vr of a 100Ω resistor 204 with a voltmeter 205. The roller resistance R is determined by the following formula.

$$\text{Roller resistance } R = \text{applied voltage} \times 100/Vr$$

A predetermined transfer voltage (transfer bias) having a positive polarity, which is opposite to the charging polarity (normal charging polarity) of the toner during development, is applied to the transfer roller 5 from a transfer power source (high-voltage power source) (not shown). As a result, the toner image on the photosensitive drum 1 sent to the transfer portion N is transferred onto the recording material P.

Meanwhile, the recording materials P stacked on a sheet stacking table 8*a* of a feeding cassette 8 are picked up one by one by the feeding roller 9 driven at a predetermined control timing, and are sent by a conveying roller 10 and the conveying roller 11 to a registration unit. In the registration unit, the leading end of the recording material P is temporarily received by the nip portion between the registration roller 12 and the registration roller 13 to correct the skew of the recording material P, and the recording material P is fed at a predetermined conveyance timing to the transfer portion N.

That is, in the registration unit, when the leading end segment of the toner image on the surface of the photosensitive drum 1 reaches the transfer portion N, the conveyance timing of the recording material P is controlled so that the leading end segment of the recording material P also reaches the transfer portion N. The recording material P that has passed through the registration unit is conveyed along the transfer entrance guide 14 and sent to the transfer portion N.

The recording material P fed to the transfer portion N is nipped by the photosensitive drum 1 and the transfer roller 5 and conveyed, while the toner image is transferred onto the recording material P.

The electric resistance of the transfer roller 5 varies depending on the ambient temperature and humidity and the durability. Further, the electric resistance also changes depending on the type of recording material and the ambient temperature and humidity, and the electric resistance also changes depending on how the toner is laid on the first side during image formation on the second side. Therefore, a control called active transfer voltage control (ATVC) is performed to control the voltage value applied to the transfer roller 5 so that a predetermined transfer current flows between the transfer roller 5 and the photosensitive drum 1. The toner image on the photosensitive drum 1 is transferred onto the recording material P by the transfer voltage determined by the ATVC control.

After that, the recording material P is separated from the surface of the photosensitive drum 1 and conveyed to a fixing device 15 as a fixing means. The untransferred toner remaining on the surface of the photosensitive drum 1 after the recording material P has been separated is removed with a cleaner 6 as a cleaning means and repeatedly used for image formation. The cleaner 6 has a cleaning blade 6*a* as a cleaning member, and a recovery container 6*b* for housing the untransferred toner scraped off by the cleaning blade 6*a* from the surface of the rotating photosensitive drum 1.

The fixing device 15 has a fixing roller 15*a* provided with a heat source as a fixing rotary member (fixing member), and a pressure roller 15*b* as a pressurizing rotating member (pressurizing member) in pressure contact with the fixing roller 15*a*. The fixing roller 15*a* and the pressure roller 15*b* come into contact with each other to form a fixing portion (heating portion) T which is a nip portion (fixing nip). The fixing device 15 fixes (fixedly attaches) the unfixed toner image to the recording material P by applying heat and pressure to the recording material P carrying the unfixed toner image at the fixing portion T.

The fixing device 15 is an example of a heating means for heating the recording material separated from the photosensitive drum 1 in a heating unit, and particularly a heating unit having a rotating body that contacts the recording material in the heating unit and rotates while heating the recording material. The recording material P discharged from the fixing device 15 is conveyed by an intermediate discharge roller 16.

Here, the image forming apparatus 100 can perform single-sided image formation (single-sided printing) in which a toner image is fixed and outputted to one side of the recording material P, and double-sided image formation (double-sided printing) in which a toner image is fixed and outputted to the first side (front side) and the second side (back side) of the recording material P.

When performing single-sided image formation, the recording material P is conveyed to a discharge roller 17 via the intermediate discharge roller 16 and discharged onto a discharge tray 18. Meanwhile, in the case of performing double-sided image formation, the recording material P is once conveyed halfway by the intermediate discharge roller 16 and then switched back by the reverse rotation of the intermediate discharge roller 16 and sent to the double-sided conveyance path 20 by the switching of a reversal flapper 19. The recording material P sent to the double-sided conveyance path 20 is transferred by a double-sided conveying roller 21, and is again sent to the registration unit by the conveying roller 10 and the conveying roller 11.

After that, image formation on the second side (back side) is performed by the same process as the image formation on the first side (front side). After the image formation on the second side, the recording material P is conveyed to the discharge roller 17 via the intermediate discharge roller 16 and discharged onto the discharge tray 18.

In the image forming apparatus, the photosensitive drum 1 and the charging roller 2, the developing device 4, and the cleaner 6 as process units that act on the photosensitive drum 1 are integrated to configure a process cartridge 7. The process cartridge 7 is detachably attached to an apparatus main body 110 that forms the housing of the image forming apparatus 100.

Next, the toner will be described in detail.

Toner

The inventors of the present invention have actively studied a toner that makes it possible to obtain an image which is free of transfer defects on the second side, without being affected by the image on the first side, in an image forming apparatus capable of printing on both sides of a recording material.

As a result, it was found that the abovementioned problem can be resolved when Tv/Fv≥8 is satisfied, where Tv stands for a volume resistivity Ω·cm of an unfixed solid image on a recording material on which the solid image has been formed using the toner at a toner laid-on level of 0.4 mg/cm$^2$, and Fv stands for a volume resistivity Ω·cm of the solid image after fixing by applying heat and pressure to the recording material.

Further, it is preferable that the surface of the toner particle has a reaction product of a polyvalent acid and a compound including a Group 4 element.

Satisfying Tv/Fv≥8 means that the volume resistivity of the image can be greatly reduced by fixing. By using such a toner, it is possible to reduce the voltage value of the transfer bias on the second surface, and thus it is possible to suppress the occurrence of transfer defects such as "penetration".

Tv/Fv is preferably 12 or more, and more preferably 80 or more. Meanwhile, the upper limit is not particularly limited, but it is preferably 5000 or less, and more preferably 1000 or less.

Tv/Fv can be controlled by the numerical value of M1 described later.

Tv is preferably from $1\times10^{9}$ Ω·cm to $1\times10^{14}$ Ω·cm, and more preferably from $1\times10^{9}$ Ω·cm to $1\times10^{13}$ Ω·cm.

Fv is preferably from $1\times10^{8}$ Ω·cm to $1\times10^{13}$ Ω·cm, and more preferably from $1\times10^{8}$ Ω·cm to $1\times10^{12}$ Ω·cm.

The polyvalent acid may be any acid as long as it is divalent or higher. Specific examples include the following.

Inorganic acids such as phosphoric acid, carbonic acid, sulfuric acid, and the like; organic acids such as dicarboxylic acids, tricarboxylic acids, and the like.

The following are specific examples of organic acids.

Dicarboxylic acids such as oxalic acid, malonic acid, succinic acid, glutaric acid, adipic acid, fumaric acid, maleic acid, pimelic acid, suberic acid, azelaic acid, sebacic acid, phthalic acid, isophthalic acid, terephthalic acid, and the like.

Tricarboxylic acids such as citric acid, aconitic acid, trimellitic anhydride, and the like.

Among them, it is preferable that the polyvalent acid includes at least one selected from the group consisting of carbonic acid, sulfuric acid, and phosphoric acid, because such acids react strongly with Group 4 elements and hardly absorb moisture. More preferably, the polyvalent acid includes phosphoric acid.

The polyvalent acid may be used as it is, or as a salt of the polyvalent acid and an alkali metal such as sodium potassium, lithium, and the like, an alkaline earth metal such as magnesium, calcium, strontium, barium, and the like, or as an ammonium salt of the polyvalent acid.

The compound including a Group 4 element is not particularly limited and any compound may be used as long as this compound includes a Group 4 element.

Examples of Group 4 elements include titanium, zirconium, hafnium and the like. Among them, the Group 4 element preferably includes at least one of titanium and zirconium.

Specific examples of compounds including titanium include the following.

Titanium alkoxides such as tetraisopropyl titanate, tetrabutyl titanate, tetraoctyl titanate, and the like.

Titanium chelates such as titanium diisopropoxybisacetylacetonate, titanium tetraacetylacetonate, titanium diisopropoxybis(ethylacetoacetate), titanium di-2-ethylhexoxybis-2-ethyl-3-hydroxyhexoxide, titanium diisopropoxybisethyl acetoacetate, titanium lactate, titanium lactate ammonium salt, titanium diisopropoxybistriethanolaminate, titanium isostearate, titanium aminoethylaminoethanolate, titanium triethanolaminate, and the like.

Among them, titanium chelates are preferable because they easily react with polyvalent acids. Further, titanium lactate and titanium lactate ammonium salt are more preferable.

Specific examples of compounds including zirconium include the following.

Zirconium alkoxides such as zirconium tetrapropoxide, zirconium tetrabutoxide, and the like.

Zirconium chelates such as zirconium tetraacetylacetonate, zirconium tributoxymonoacetylacetonate, zirconium dibutoxybis(ethylacetoacetate), zirconium lactate, zirconium lactate ammonium salt, and the like.

Among them, zirconium chelates are preferable because they easily react with polyvalent acids. Further, zirconium lactate and zirconium lactate ammonium salt are more preferable.

Specific examples of compounds including hafnium include the following.

Hafnium chelates such as hafnium lactate and hafnium lactate ammonium salt.

A state where the toner particle surface has a reaction product of a polyvalent acid and a compound including a Group 4 element means is, for example, a state where a reaction product of a polyvalent acid and a compound including a Group 4 element is present on the toner particle surface.

For example, the following various conventionally known methods can be used for causing a reaction product of a polyvalent acid and a compound including a Group 4 element to be present on the toner particle surface.

A method of obtaining toner particles by reacting a polyvalent acid with a compound including a Group 4 element in a toner base particle-dispersed solution and attaching the obtained reaction product to the surface of the toner base particles.

For example, a method of obtaining toner particles by adding and mixing a polyvalent acid with a compound including a Group 4 element in a toner base particle-dispersed solution to react the polyvalent acid with the compound including a Group 4 element and obtain a reaction product, and at the same time stirring the dispersion liquid to attach the reaction product to the surface of the toner base particles.

Further, for example, a method of obtaining toner particles by reacting a polyvalent acid with a compound including a Group 4 element to prepare fine particles including the reaction product, and then mixing the fine particles with the toner base particles to attach the fine particles including the reaction product to the surface of the toner base particles.

Specifically, the toner base particles and the fine particles of the reaction product may be mixed using a high-speed stirrer such as an FM MIXER, MECHANO-HYBRID (manufactured by Nippon Coke Co., Ltd.), a SUPER MIXER, and NOBILTA (manufactured by Hosokawa Micron Ltd.).

The reaction product of a polyvalent acid and a compound including the Group 4 element can be obtained by reacting the polyvalent acid and the compound including the Group 4 element in a solvent.

Any solvent can be used as the solvent.

Specific examples of the solvent include the following.

Hexane, benzene, toluene, diethyl ether, chloroform, ethyl acetate, tetrahydrofuran, acetone, acetonitrile, N, N-dimethylformamide, 1-butanol, 1-propanol, 2-propanol, methanol, ethanol, and water.

The reaction product of a polyvalent acid and a compound including a Group 4 element is not particularly limited. Salts of polyvalent acids and Group 4 elements (hereinafter also referred to as polyvalent acid metal salts) are preferable. From the viewpoint of reducing the volume resistivity, it is preferable that at least one selected from the group consisting of titanium sulfate, titanium carbonate, titanium phosphate, zirconium sulfate, zirconium carbonate, and zirconium phosphate be included.

More preferably, at least one of titanium phosphate and zirconium phosphate is included.

Polyvalent acids receive electron pairs and are easily negatively charged. Therefore, the reaction product of a polyvalent acid and a compound including a Group 4 element is also easily negatively charged and has excellent chargeability.

Furthermore, Group 4 elements are most stable when the oxidation number is +4. Therefore, a crosslinked structure is formed with the polyvalent acid, and the crosslinked structure promotes electron transfer.

The reaction product of a polyvalent acid and a compound including a Group 4 element has a crosslinked structure composed of the polyvalent acid and the metal element, and thus has the property of easily transferring charges. Therefore, the electric charge applied to the surface of the toner easily propagates through the cross-linked structure to the entire surface.

Where the toner is heated and pressed by fixing, the reaction product of a polyvalent acid and a compound including the Group 4 element on the toner particle surface mixes with the melted toner particle. As a result, a property of facilitating the transfer of charges inside the toner particles is demonstrated. As a result, the volume resistance value after fixing is lower than that before fixing.

Meanwhile, in a toner that does not have the reaction product of a polyvalent acid and a compound including a Group 4 element on the surface, for example, a toner including titanium oxide as an electric resistance adjusting agent, the charge imparted by contact does not easily move on the surface, and the electric charge is likely to be localized on (the contact portion of) the surface. Further, in the toner including titanium oxide, the charge transfer is less likely to be caused by contact between the toner particles than in the toner having the reaction product of a polyvalent acid and a compound including a Group 4 element.

Furthermore, even where the toner is heated and pressed by fixing, the toner including titanium oxide does not exhibit the property of transferring electric charges inside the toner particles. As a result, there is no significant difference between the volume resistivity after fixing and the volume resistivity before fixing, and it is considered that the effect of the toner of the present disclosure is not produced.

The number average particle diameter of the fine particles including the reaction product of a polyvalent acid and a compound including a Group 4 element is preferably from 1 nm to 400 nm, more preferably from 1 nm to 200 nm, and even more preferably from 1 nm to 60 nm.

By setting the number average particle diameter of the fine particles within the above range, it is possible to suppress member contamination due to detachment of the fine particles.

The number average particle diameter of the fine particles can be adjusted to the above range by adjusting the addition amount of the polyvalent acid and the compound including a Group 4 element, which are the starting materials of the fine particles, the pH at which the components react, and the temperature at the time of reaction.

The amount of the reaction product of the polyvalent acid and the compound including a Group 4 element in the toner particle is preferably from 0.01% by mass to 5.00% by mass, and more preferably from 0.02% by mass to 3.00% by mass.

The reaction product of a polyvalent acid and a compound including the Group 4 element is preferably a polyvalent acid metal salt.

Where a metal element contained in the polyvalent acid metal salt is defined as a metal element M, and a ratio of the metal element M in constituent elements of the surface of the toner, which is determined from a spectrum obtained by X-ray photoelectron spectroscopy analysis of the toner, is denoted by M1 (atomic %), the M1 is preferably from 1.0 atomic % to 10.0 atomic %.

Further, where a toner obtained by performing a treatment (a) of dispersing 1.0 g of the toner in a mixed aqueous solution including 31.0 g of a 61.5% by mass sucrose solution and 6.0 g of a 10% by mass aqueous solution of a neutral detergent for cleaning precision measuring instruments, which comprises a nonionic surfactant, an anionic surfactant and an organic builder, and shaking for 20 min at a rate of 300 cycles per 1 min by using a shaker is defined as a toner (a), and a ratio of the metal element M in constituent elements of the surface of the toner (a), which is determined from a spectrum obtained by X-ray photoelectron spectroscopy analysis of the toner (a), is denoted by M2 (atomic %), both M1 and M2 are preferably from 1.0 to 10.0.

Further, it is preferable that M1 and M2 satisfy a following formula (ME-1).

$$0.90 \leq M2/M1 \quad \text{(ME-1)}$$

More preferably, M2/M1 is 0.95 or more. The upper limit is not particularly limited, but is preferably 1.00 or less.

In the treatment (a), the polyvalent acid metal salt weakly attached to the toner particle surface can be removed. Specifically, the polyvalent acid metal salt attached by a dry method to the toner base particle is easily removed by the treatment (a). Thus, the treatment (a) makes it possible to evaluate the polyvalent acid metal salt present on the toner surface. The smaller the change in each parameter due to the treatment (a), the stronger the polyvalent acid metal salt is attached to the toner base particle.

M1 and M2 represent the coating state of the toner base particle surface with the polyvalent acid metal salt before and after the treatment (a). The coating state of the surface of the toner base particles with the polyvalent acid metal salt contributes to the charging performance and charge mobility.

It is preferable that each of M1 and M2 be from 1.0 atomic % to 10.0 atomic %. When M1 and M2 are in the above ranges, the negative chargeability and charge mobility of the toner are further improved.

Each of M1 and M2 is more preferably from 1.0 atomic % to 7.0 atomic %, and further preferably from 1.5 atomic % to 5.0 atomic %.

M1 can be controlled by the attachment amount, attachment method, attachment conditions, and the like of the polyvalent acid metal salt during toner production.

M2/M1 means the ratio of the polyvalent acid metal salt remaining without being peeled from the surface of the toner base particles in the treatment (a). When M2/M1 is 0.90 or more, the polyvalent acid metal salt is strongly attached to the surface of the toner base particle, so that the migration of the polyvalent acid metal salt from the toner to the member is suppressed. Therefore, it is possible to obtain a toner that is stable even after long-term use and has excellent durability.

M2/M1 can be controlled by the production method, attachment method, attachment conditions, and the like of the polyvalent acid metal salt during toner production.

When the polyvalent acid and the compound including a Group 4 element are reacted in the toner base particle-dispersed solution and the obtained reaction product is attached to the surface of the toner base particles to obtain toner particles, it is preferable to use in combination an organosilicon compound represented by the following formula (2).

As a result of using the organosilicon compound in combination, the obtained reaction product is more firmly attached to the toner particle, the reaction product of the polyvalent acid and the compound including a Group 4 element is hydrophobized, and environmental stability is further improved.

Specifically, first, a toner base particle-dispersed solution is prepared. Then, an organosilicon compound represented by the following formula (2) is hydrolyzed. The organosilicon compound may be hydrolyzed in advance or may be hydrolyzed in the dispersion liquid of the toner base particles.

Then, when the polyvalent acid is reacted with the compound including a Group 4 element in the toner base particle-dispersed solution and the obtained reaction product is attached to the surface of the toner base particles, the hydrolyzate is condensed to obtain toner particles.

The obtained condensate migrates to the toner particle surface. Since the condensate is viscous, the reaction product of the polyvalent acid and the compound including a Group 4 element can be brought into close contact with the toner particle surface to more firmly fix the reaction product to the toner particle.

$$R_{a(n)}\text{—Si—}R_{b(4-n)} \quad (2)$$

Where, $R_a$ represents a halogen atom, a hydroxy group or an alkoxy group (preferably having from 1 to 4 carbon atoms, and more preferably from 1 to 3 carbon atoms), and $R_b$ represents an alkyl group (preferably having from 1 to 8 carbon atoms, and more preferably from 1 to 6 carbon atoms), an alkenyl group (preferably having from 1 to 6 carbon atoms, and more preferably from 1 to 4 carbon atoms), an aryl group (preferably having from 6 to 14 carbon atoms, and more preferably from 6 to 10 carbon atoms), an acyl group (preferably having from 1 to 6 carbon atoms, and more preferably from 1 to 4 carbon atoms), or a methacryloxyalkyl group; n represents an integer of 2 to 4. However, where a plurality of $R_a$ and $R_b$ is present, the substituents of the plurality of $R_a$ and the plurality of $R_b$ may be the same or different).

Hereinafter, $R_a$ in formula (2) will be referred to as a functional group, and $R_b$ will be referred to as a substituent.

As the organosilicon compound represented by the formula (2), a known organosilicon compound can be used without particular limitation. Specific examples include the following bifunctional silane compounds having two functional groups, trifunctional silane compounds having three functional groups, and tetrafunctional silane compounds having four functional groups.

Examples of difunctional silane compounds include dimethyldimethoxysilane, dimethyldiethoxysilane, and the like.

Examples of trifunctional silane compounds include the following.

Trifunctional silane compounds having an alkyl group as a substituent, such as ethyltrimethoxysilane, methyltriethoxysilane, methyldiethoxymethoxysilane, methylethoxydimethoxysilane, ethyltrimethoxysilane, ethyltriethoxysilane, propyltrimethoxysilane, propyltriethoxysilane, butyltrimethoxysilane, butyltriethoxysilane, hexyltrimethoxysilane, hexyltriethoxysilane, octyltrimethoxysilane, octyltriethoxysilane, decyltrimethoxysilane, decyltriethoxysilane, and the like;

trifunctional silane compounds having an alkenyl group as a substituent, such as vinyltrimethoxysilane, vinyltriethoxysilane, allyltrimethoxysilane, and allyltriethoxysilane; trifunctional silane compounds having an aryl group as a substituent, such as phenyltrimethoxysilane, phenyltriethoxysilane, and the like;

trifunctional silane compounds having a methacryloxyalkyl group as a substituent, such as γ-methacryloxypropyltrimethoxysilane, γ-methacryloxypropyltriethoxysilane, γ-methacryloxypropyldiethoxymethoxysilane, γ-methacryloxypropylethoxydimethoxysilane, and the like; and the like.

Examples of tetrafunctional silane compounds include tetramethoxysilane, tetraethoxysilane, tetrapropoxysilane, tetrabutoxysilane, and the like.

The amount of the condensate of at least one organosilicon compound selected from the group consisting of the organosilicon compounds represented by the formula (2) in the toner particle is preferably from 0.1% by mass to 20.0% by mass, and more preferably from 0.5% by mass to 15.0% by mass.

The surface of the toner particles preferably has an organosilicon polymer. The organosilicon polymer can be obtained, for example, by condensing the organosilicon compound represented by the formula (2).

The organic silicon polymer preferably has a structure represented by a following formula (II).

$$R—SiO_{3/2}$$

Where, R represents an alkyl group (preferably having from 1 to 8 carbon atoms, and more preferably from 1 to 6 carbon atoms), an alkenyl group (preferably having from 1 to 6 carbon atoms, more preferably from 1 to 4 carbon atoms), an acyl group (preferably having from 1 to 6 carbon atoms, and more preferably from 1 to 4 carbon atoms), an aryl group (preferably having from 6 to 14 carbon atoms, and more preferably from 6 to 10 carbon atoms) or a methacryloxyalkyl group.

Formula (II) indicates that the organosilicon polymer has an organic group and a silicon polymer part. As a result, in the organosilicon polymer having the structure represented by the formula (II), the organic group has affinity for the toner base particle and is therefore strongly fixed to the toner base particle, and the silicon polymer part has affinity for the reaction product of the compound including a polyvalent acid and a Group 4 element, and is therefore strongly fixed to the reaction product.

Also, the formula (II) indicates that the organosilicon polymer is crosslinked. When the organosilicon polymer has a crosslinked structure, the strength of the organosilicon polymer is increased, and the number of remaining silanol groups is reduced, so that the hydrophobicity is increased. Therefore, a more excellent durability is obtained.

In the formula (II), R is preferably an alkyl group having from 1 to 6 carbon atoms such as a methyl group, a propyl group, a normal hexyl group, and the like, a vinyl group, a phenyl group, or a methacryloxypropyl group, and more preferably an alkyl group having from 1 to 6 carbon atoms or a vinyl group. The organosilicon polymer having the above structure has both hardness and flexibility due to controlled molecular mobility of the organic group, so that deterioration of the toner is suppressed and excellent performance is exhibited even when the toner is used for a long period of time.

A method for producing the toner base particles is not particularly limited, and known suspension polymerization method, dissolution suspension method, emulsion aggregation method, pulverization method, and the like can be used.

When the toner base particles are manufactured in an aqueous medium, the aqueous medium including the toner base particles may be used as it is as a dispersion liquid of the toner base particles. Further, it may be washed, filtered and dried and then redispersed in an aqueous medium to obtain a toner base particle-dispersed solution.

Meanwhile, when produced by a dry method, the toner base particles may be dispersed in an aqueous medium by a known method to obtain a toner base particle-dispersed solution. In order to disperse the toner base particles in the aqueous medium, the aqueous medium preferably includes a dispersion stabilizer.

A specific production example of toner base particles using the suspension polymerization method will be described below.

First, a polymerizable monomer capable of forming a binder resin, and various additives as required, are mixed, and a disperser is used to prepare a polymerizable monomer composition in which these materials are dissolved or dispersed.

As various additives, colorants, waxes, charge control agents, polymerization initiators, chain transfer agents, and the like can be mentioned.

Examples of the disperser include a homogenizer, a ball mill, a colloid mill, and an ultrasonic disperser.

Then, the polymerizable monomer composition is placed in an aqueous medium including poorly water-soluble inorganic fine particles, and droplets of the polymerizable monomer composition are prepared using a high-speed disperser such as a high-speed stirrer or an ultrasonic disperser (granulation step).

After that, the polymerizable monomer in the droplets is polymerized to obtain toner base particles (polymerization step).

The polymerization initiator may be mixed when preparing the polymerizable monomer composition, or may be mixed in the polymerizable monomer composition immediately before forming droplets in the aqueous medium.

Also, during the granulation of the droplets or after the completion of the granulation, that is, immediately before the start of the polymerization reaction, the polymerization initiator can be added in a state of being dissolved in the polymerizable monomer or another solvent, if necessary.

After polymerizing the polymerizable monomer to obtain resin particles, solvent removal treatment may be performed, as necessary, to obtain a dispersion liquid of toner base particles.

The following resins or polymers can be exemplified as the binder resin.

Vinyl resins; polyester resins; polyamide resins; furan resins; epoxy resins; xylene resins; silicone resins.

Among these, vinyl resins are preferable. Examples of vinyl resins include polymers of the following monomers and copolymers thereof. Of these, a copolymer of a styrene-based monomer and an unsaturated carboxylic acid ester is preferable.

Styrene-based monomers such as styrene, α-methylstyrene, and the like; unsaturated carboxylic acid esters such as methyl acrylate, butyl acrylate, methyl methacrylate, 2-hydroxyethyl methacrylate, t-butyl methacrylate, 2-ethylhexyl methacrylate, and the like; unsaturated carboxylic acids such as acrylic acid, methacrylic acid, and the like; unsaturated dicarboxylic acids such as maleic acid and the like; unsaturated dicarboxylic acid anhydrides such as maleic anhydride and the like; nitrile-based vinyl monomers such as acrylonitrile and the like; halogen-containing vinyl monomers such as vinyl chloride and the like; nitro vinyl monomers such as nitrostyrene and the like.

The following black pigments, yellow pigments, magenta pigments, cyan pigments, and the like can be used as colorants.

Black pigments can be exemplified by carbon black and the like.

Yellow pigments can be exemplified by monoazo compounds; disazo compounds; condensed azo compounds; isoindolinone compounds; isoindoline compounds; benzimidazolone compounds; anthraquinone compounds; azo metal complexes; methine compounds; and allylamide compounds.

Specific examples include C. I. Pigment Yellow 74, 93, 95, 109, 111, 128, 155, 174, 180, 185, and the like.

Magenta pigments can be exemplified by monoazo compounds; condensed azo compounds; diketopyrrolopyrrole compounds; anthraquinone compounds; quinacridone compounds; basic dye lake compounds; naphthol compounds: benzimidazolone compounds; thioindigo compounds; and perylene compounds.

Specific examples include C. I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254, 269, C. I. Pigment Violet 19, and the like.

Cyan pigments can be exemplified by copper phthalocyanine compounds and derivatives thereof; anthraquinone compounds; and basic dye lake compounds.

Specific examples include C. I. Pigment Blue 1, 7, 15, 15:1, 15:2, 15:3, 15:4, 60, 62, and 66.

Also, various dyes conventionally known as colorants may be used together with the pigments.

The amount of the colorant is preferably from 1.0 part by mass to 20.0 parts by mass with respect to 100 parts by mass of the binder resin.

The toner can also be made into a magnetic toner by including magnetic bodies. In this case, the magnetic body can also serve as a coloring agent.

Examples of the magnetic body include iron oxides represented by magnetite, hematite, ferrite, and the like; metals represented by iron, cobalt, nickel, and the like or alloys of these metals with metals such as aluminum, cobalt, copper, lead, magnesium, tin, zinc, antimony, beryllium, bismuth, cadmium, calcium, manganese, selenium, titanium, tungsten, vanadium, and the like, and mixtures thereof.

Examples of waxes are presented hereinbelow.

Esters of monovalent alcohols such as behenyl behenate, stearyl stearate, palmityl palmitate, and the like and aliphatic monocarboxylic acids, or esters of monovalent carboxylic acids and aliphatic monoalcohols; esters of divalent alcohols such as dibehenyl sebacate, hexanediol dibehenate, and the like and aliphatic monocarboxylic acids, or esters of divalent carboxylic acids and aliphatic monoalcohols; esters of trivalent alcohols such as glycerin tribehenate and the like and aliphatic monocarboxylic acids, or esters of trivalent carboxylic acids and aliphatic monoalcohols; esters of tetravalent alcohols such as pentaerythritol tetrastearate, pentaerythritol tetrapalmitate, and the like and aliphatic monocarboxylic acids, or tetravalent carboxylic acids and aliphatic monoalcohols; esters of hexavalent alcohols such as dipentaerythritol hexastearate, dipentaerythritol hexapalmitate, and the like and aliphatic monocarboxylic acid esters, or esters of hexavalent carboxylic acids and aliphatic monoalcohols; esters of polyvalent alcohols such as polyglycerin behenate and the like and aliphatic monocarboxylic acid, or esters of polyvalent carboxylic acids and aliphatic monoalcohols; natural ester waxes such as carnauba wax, rice wax, and the like; petroleum waxes such as paraffin wax, microcrystalline wax, petrolatum, and derivatives thereof; hydrocarbon waxes obtained by Fischer-Tropsch method and derivatives thereof; polyolefin waxes such as polyethylene wax, polypropylene wax, and the like and derivatives thereof; higher aliphatic alcohols; fatty acids such as stearic acid, palmitic acid, and the like; and acid amide waxes.

The amount of wax is preferably from 0.5 parts by mass to 20.0 parts by mass with respect to 100 parts by mass of the binder resin.

In the toner, various organic or inorganic fine particles may be externally added to the toner particle to the extent that the characteristics and effects are not impaired. For example, the following are used as the organic and inorganic fine particles.

(1) Flowability-imparting agents: silica, alumina, titanium oxide, carbon black and carbon fluoride.

(2) Abrasives: metal oxides (for example, strontium titanate, cerium oxide, alumina, magnesium oxide, chromium oxide), nitrides (for example, silicon nitride), carbides (for example, silicon carbide), metal salts (for example, calcium sulfate, barium sulfate, calcium carbonate).

(3) Lubricants: fluorine-based resin fine particles (for example, vinylidene fluoride and polytetrafluoroethylene), fatty acid metal salts (for example, zinc stearate and calcium stearate).

(4) Charge controlling particles: metal oxides (for example, tin oxide, titanium oxide, zinc oxide, silica, and alumina) and carbon black.

The organic or inorganic fine particles can be hydrophobized. Examples of treatment agents for hydrophobic treatment of organic or inorganic fine particles include an unmodified silicone varnish, various modified silicone varnishes, unmodified silicone oil, various modified silicone oils, silane compounds, silane coupling agents, other organosilicon compounds, and organotitanium compounds. These treatment agents may be used alone or in combination.

Methods for measuring physical property values are described below. Method for Measuring Weight Average Particle Diameter (D4) and Number Average Particle Diameter (D1) of Toner Particles and the Like The weight average particle diameter (D4) and number average particle diameter (D1) of the toner base particles, toner particles or toner (hereinafter, simply referred to as toner particles in the description of the measurement method) are calculated as follows.

As a measuring device, a precision particle diameter distribution measuring device "Coulter Counter Multisizer 3" (registered trademark, manufactured by Beckman Coulter, Inc.) equipped with a 100 μm aperture tube and based on a pore electrical resistance method is used. The dedicated software "Beckman Coulter Multisizer 3, Version 3.51" (manufactured by Beckman Coulter Co., Ltd.) provided with the device is used to set the measurement conditions and analyze the measurement data. The measurement is performed with the number of effective measurement channels of 25,000.

A solution prepared by dissolving special grade sodium chloride in ion exchanged water so that the concentration becomes 1.0%, for example, "ISOTON II" (manufactured by Beckman Coulter, Inc.), can be used as an electrolytic aqueous solution to be used for the measurement.

Before measurement and analysis, the dedicated software is set in the following manner.

On the "CHANGE STANDARD MEASUREMENT METHOD (SOMME)" screen of the dedicated software, the total count number in the control mode is set to 50,000 particles, the number of measurements is set to 1, and a value obtained using "STANDARD PARTICLES 10.0 μm" (manufactured by Beckman Coulter, Inc.) is set as a Kd value.

The threshold and the noise level are automatically set by pressing a "MEASUREMENT BUTTON OF THRESHOLD/NOISE LEVEL". Further, the current is set to 1600 μA, the gain is set to 2, the electrolytic solution is set to ISOTON II, and "FLUSH OF APERTURE TUBE AFTER MEASUREMENT" is checked.

On the "PULSE TO PARTICLE DIAMETER CONVERSION SETTING" screen of the dedicated software, the bin interval is set to a logarithmic particle diameter, the particle diameter bin is set to a 256-particle diameter bin, and a particle diameter range is set from 2 μm to 60 μm.

The specific measurement method is described hereinbelow.

(1) A total of 200.0 mL of the electrolytic aqueous solution is placed in a glass 250 mL round-bottom beaker dedicated to Multisizer 3, the beaker is set in a sample stand, and stirring with a stirrer rod is carried out counterclockwise at 24 revolutions per second. Dirt and air bubbles in the aperture tube are removed by the "FLUSH OF APERTURE TUBE" function of the dedicated software.

(2) A total of 30.0 mL of the electrolytic aqueous solution is placed in a glass 100 mL flat-bottom beaker. Then, 0.3 mL of a diluted solution obtained by 3-fold mass dilution of "CONTAMINON N" (trade name) (10% by mass aqueous solution of a neutral detergent having a pH of 7 and composed of a nonionic surfactant, an anionic surfactant, and an organic builder for washing precision measuring instruments; manufactured by Wako Pure Chemical Industries, Ltd.) with ion exchanged water is added as a dispersant to the electrolytic aqueous solution.

(3) An ultrasonic disperser "Ultrasonic Dispersion System Tetra 150" (manufactured by Nikkaki Bios Co., Ltd.) with an electrical output of 120 W in which two oscillators with an oscillation frequency of 50 kHz are built in with a phase shift of 180 degrees is prepared. A total of 3.3 L of ion exchanged water is poured into the water tank of the ultrasonic disperser, and 2.0 mL of the CONTAMINON N is added to the water tank.

(4) The beaker of (2) hereinabove is set in the beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(5) A total of 10 mg of the toner is added little by little to the electrolytic aqueous solution and dispersed therein in a state in which the electrolytic aqueous solution in the beaker of (4) hereinabove is irradiated with ultrasonic waves. Then, the ultrasonic dispersion process is further continued for 60 sec. In the ultrasonic dispersion, the water temperature in the water tank is appropriately adjusted to a temperature from 10° C. to 40° C.

(6) The electrolytic aqueous solution of (5) hereinabove in which the toner particles have been dispersed is dropped using a pipette into the round bottom beaker of (1) hereinabove which has been set in the sample stand, and the measurement concentration is adjusted to be 5%. Then, measurement is conducted until the number of particles to be measured reached 50,000.

(7) The measurement data are analyzed with the dedicated software provided with the apparatus, and the weight average particle diameter (D4) and the number average particle diameter (D1) are calculated. The "AVERAGE DIAMETER" on the "ANALYSIS/VOLUME STATISTICAL VALUE (ARITHMETIC MEAN)" screen when the dedicated software is set to graph/volume % is the weight average particle diameter (D4). The "AVERAGE DIAMETER" on the "ANALYSIS/NUMBER STATISTICAL VALUE (ARITHMETIC MEAN)" screen when the dedicated software is set to graph/number % is the number average particle diameter (D1).

Calculation Method of Ratios M1 and M2 of Metal Element M Using X-ray Photoelectron Spectroscopy Treatment (a)

A total of 160 g of sucrose (manufactured by Kishida Chemical Co., Ltd.) is added to 100 mL of ion exchanged water and dissolved while forming a hot water bath to prepare a sucrose aqueous solution having a concentration of 61.5% by mass. Then, 31.0 g of the sucrose aqueous solution and 6.0 g of CONTAMINON N (trade name) (10% by mass aqueous solution of a neutral detergent for washing precision measuring instruments having a pH of 7 and consisting of a nonionic surfactant, an anionic surfactant, and an organic builder; manufactured by Wako Pure Chemical Industries, Ltd.) are placed in a centrifuge tube (capacity 50 mL) to prepare a dispersion liquid.

To this dispersion liquid, 1.0 g of the toner is added, and the lumps of the toner are loosened with a spatula or the like. The centrifuge tube is shaken at 300 spm (strokes per min) with an amplitude of 4 cm for 20 min with a shaker (AS-1N made by AS ONE Corporation) equipped with an optional centrifugal sedimentation tube holder (made by AS ONE Corporation) for a universal shaker.

After shaking, the solution is transferred into a glass tube (50 mL) for a swing rotor and separated by a centrifuge under the conditions of 3500 rpm and 30 min. It is visually confirmed that the toner and the aqueous solution are sufficiently separated, and the toner separated in the uppermost layer is collected with a spatula or the like. The collected toner is filtered with a vacuum filter and then dried with a dryer for 1 h or longer. The dried product is crushed with a spatula to obtain a toner (a).

With respect to the toner and the toner (a), the measurement is performed as follows using X-ray photoelectron spectroscopy, and M1 and M2 are calculated.

The ratios M1 and M2 of the metal element M are calculated by measuring each of the above toners under the following conditions.

Measuring device: X-ray photoelectron spectrometer: Quantum2000 (manufactured by ULVAC-PHI, Inc.)

X-ray source: monochrome Al Kα

Xray Setting: 100 μmϕ (25 W (15 KV))

Photoelectron take-off angle: 45 degrees

Neutralization condition: neutralizing gun and ion gun used together

Analysis area: 300×200 μm

Pass Energy: 58.70 eV

Step size: 0.1.25 eV

Analysis software: Maltipak (PHI, Inc.)

Next, a method for obtaining the quantitative value of the metal element by analysis will be described below by taking the case of using Ti as the metal element as an example. First, the peak derived from the C—C bond of the carbon is orbital is corrected to 285 eV. After that, the amount of Ti derived from the Ti element relative to the total amount of the constituent elements is calculated by using the relative sensitivity factor provided by ULVAC-PHI Inc., from the peak area derived from the Ti 2*p* orbital where the peak top is detected at from 452 eV to 468 eV, and the calculated value is taken as the quantitative value M1 (atomic %) of the Ti element on the surface of the toner.

Using the above method, the toner and the toner (a) are measured, and the ratio of the metal element M on the surface of each toner obtained from the obtained spectrum is taken as M1 (atomic %) and M2 (atomic %), respectively.

Method for Detecting Reaction Product of Polyvalent Acid and Compound Including Group 4 Element Using the time-of-flight secondary ion mass spectrometry (TOF-SIMS), the reaction product (preferably polyvalent acid metal salt) of a polyvalent acid and a compound including a Group 4 element on the surface of the toner is detected by the following method.

A toner sample is analyzed using TOF-SIMS (TRIFTIV: manufactured by ULVAC-PHI) under the following conditions.

Primary ion species: cold ions ($Au^+$)
Primary ion current value: 2 pA
Analysis area: 300×300 $\mu m^2$
Number of pixels: 256×256 pixels
Analysis time: 3 min
Repetition frequency: 8.2 kHz
Charge neutralization: ON
Secondary ion polarity: positive
Secondary ion mass range: m/z from 0.5 to 1850
Sample substrate: indium Analysis is performed under the above conditions, and where peaks derived from secondary ions including metal ions and polyvalent acid ions (for example, $TiPO_3$ (m/z 127), $TiP_2O_5$ (m/z 207), and the like in the case of titanium phosphate) are detected, it is assumed that the reaction product of the polyvalent acid and the compound including the Group 4 element is present on the surface of the toner.

Confirmation of Organosilicon Polymer

Using a transmission electron microscope (TEM), a cross section of the toner is observed by the following method.

First, the toner is sufficiently dispersed in a normal-temperature-curable epoxy resin, followed by curing in an atmosphere of 40° C. for 2 days.

Using a microtome (EM UC7: manufactured by Leica) equipped with a diamond blade, a flaky sample with a thickness of 50 nm is cut out from the obtained cured product.

This sample is magnified at a magnification of 500,000 times using a TEM (JEM2800 type: manufactured by JEOL Ltd.) under the conditions of an acceleration voltage of 200 V and an electron beam probe size of 1 mm, and a cross section of the toner is observed. At this time, according to the above-described method for measuring the number average particle diameter (D1) of the toner, the toner cross section having the maximum diameter of 0.9 times to 1.1 times the number average particle diameter (D1) when the same toner is measured is selected.

Subsequently, the constituent elements in the obtained toner cross section are analyzed by using energy dispersive X-ray spectroscopy (EDX), and an EDX mapping image (256×256 pixels (2.2 nm/pixel), integration number 200 times) is produced.

In the produced EDX mapping image, a signal derived from the silicon element on the surface of the toner base particle is observed, and when the signal is confirmed to be derived from the organosilicon polymer by comparison with a standard described below, the signal is assumed to be the image of the organosilicon polymer.

The organosilicon polymer on the toner particle surface is confirmed by comparing the element content ratio (atomic %) of Si and O (Si/O ratio) with that of the standard product.

EDX analysis is performed under the above conditions for each standard product of the organosilicon polymer and silica fine particles to obtain the elemental contents (atomic %) of Si and O, respectively.

The Si/O ratio of the organosilicon polymer is denoted by A and the Si/O ratio of the silica fine particles is denoted by B. A measurement condition in which A is significantly larger than B is selected.

Specifically, the standard is measured 10 times under the same conditions, and the arithmetic mean values of A and B are obtained. A measurement condition at which the obtained average value is A/B>1.1 is selected.

When the Si/O ratio of the portion where silicon observed in the toner cross section is detected is on the A side of [(A+B)/2], the portion is determined to be an organosilicon polymer.

TOSPEARL 120A (Momentive Performance Materials Japan LLC) is used as a standard for organosilicon polymer particles, and HDK V15 (Asahi Kasei Corp.) is used as a standard for silica fine particles.

EXAMPLES

The present disclosure will be specifically described by the following examples. However, the examples do not limit the present disclosure in any way. All "parts" in the following formulations are based on mass unless otherwise specified.

Production Examples of Toner

Production Example of Toner Base Particle-Dispersed Solution

A total of 11.2 parts of sodium phosphate (12-hydrate) was placed in a reaction vessel including 390.0 parts of ion exchanged water, and the temperature was kept at 65° C. for 1.0 h while purging with nitrogen. Using a T. K. HOMOMIXER (manufactured by Tokushu Kika Kogyo Co., Ltd.), stirring was performed at 12,000 rpm. While maintaining stirring, an aqueous calcium chloride solution prepared by dissolving 7.4 parts of calcium chloride (dihydrate) in 10.0 parts of ion exchanged water was put all at once into the reaction vessel to prepare an aqueous medium including a dispersion stabilizer. Further, 1.0 mol/L hydrochloric acid was added to the aqueous medium in the reaction vessel to adjust the pH to 6.0 and prepare the aqueous medium.

Preparation of Polymerizable Monomer Composition

Styrene: 60.0 parts
Carbon black "Nipex 35 (manufactured by Orion Engineered Carbons LLC)": 6.3 parts The above materials were put into an attritor (manufactured by Nippon Coke Industry Co., Ltd.) and further dispersed using zirconia particles having a diameter of 1.7 mm at 220 rpm for 5.0 h to prepare a colorant-dispersed solution in which a pigment was dispersed.

Next, the following materials were added to the colorant-dispersed solution.

Styrene: 10.0 parts
N-butyl acrylate: 30.0 parts
Polyester resin: 5.0 parts
(polycondensation product of terephthalic acid and propylene oxide 2 mol adduct of bisphenol A, weight average molecular weight Mw=10,000, acid value: 8.2 mg KOH/g)

HNP9 (melting point: 76° C., manufactured by Nippon Seiro Co., Ltd.): 6.0 parts

The above materials were heated to 65° C. and uniformly dissolved and dispersed using a T. K. HOMOMIXER at 500 rpm to prepare a polymerizable monomer composition.

Granulation Step

The polymerizable monomer composition was loaded into the aqueous medium while maintaining the temperature of the aqueous medium at 70° C. and the number of revolutions of the stirrer at 12,000 rpm, and 8.0 parts of t-butylperoxypivalate as a polymerization initiator was added. Granulation was performed for 10 min while maintaining 12,000 rpm with a stirrer.

Polymerization Step

The high-speed stirrer was replaced with a stirrer equipped with a propeller stirring blade, polymerization was performed for 5.0 h while stirring at 200 rpm and holding the temperature at 70° C., the temperature was then raised to 85° C., and heating was performed for 2.0 h to carry out a polymerization reaction.

Furthermore, the residual monomer was removed by raising the temperature to 98° C. and heating for 3.0 h, ion exchanged water was added to adjust the concentration of toner base particles in the dispersion liquid to 30.0% by mass, and a toner base particle-dispersed solution in which toner base particles were dispersed was obtained.

The number average particle diameter (D1) of the toner base particles was 6.2 μm, and the weight average particle diameter (D4) was 6.9 μm.

Production Example of Organosilicon Compound Liquid

Ion exchanged water: 70.0 parts

Methyltriethoxysilane: 30.0 parts

The above materials were weighed in a 200 mL beaker and the pH was adjusted to 3.5 with 10% hydrochloric acid. Then, stirring was performed for 1.0 h while heating at 60° C. the water bath to produce an organosilicon compound liquid.

Production Example of Polyvalent Acid Metal Salt Fine Particles

Ion exchanged water: 100.0 parts

Sodium phosphate (12 hydrate): 8.5 parts

After mixing the above materials, 60.0 parts (equivalent to 7.2 parts as zirconium lactate ammonium salt) of zirconium lactate ammonium salt (ZC-300, Matsumoto Fine Chemical Co., Ltd.) was added while stirring at 10,000 rpm with T. K. HOMOMIXER (manufactured by Tokushu Kika Kogyo Co., Ltd.) at room temperature. The pH was adjusted to 7.0 by adding 1.0 mol/L hydrochloric acid. The temperature was adjusted to 70° C., and the reaction was carried out for 1 h while maintaining stirring.

After that, the solid content was taken out by centrifugation. Subsequently, the steps of redispersing in ion exchanged water and extracting the solid content by centrifugation were repeated 3 times to remove ions such as sodium. Then, dispersion in ion exchanged water and drying by spray drying were performed again to obtain zirconium phosphate compound fine particles having a number average particle diameter of 22 nm.

Toner 1

Polyvalent Metal Salt Attachment Process

The following samples were weighed in the reaction vessel and mixed using a propeller stirring blade.

Toner base particle-dispersed solution: 500.0 parts

44% aqueous solution of titanium lactate (TC-310: manufactured by Matsumoto Fine Chemical Co., Ltd.): 4.3 parts (equivalent to 1.9 parts as titanium lactate)

Organosilicon compound liquid: 10.0 parts

Next, the pH of the obtained mixed liquid was adjusted to 9.5 using a 1.0 mol/L NaOH aqueous solution, and the liquid mixture was kept for 5.0 h. After the temperature was lowered to 25° C., the pH was adjusted to 1.5 with 1.0 mol/L hydrochloric acid, the mixture was stirred for 1.0 h, and then filtered while washing with ion exchanged water. The obtained powder was dried in a thermostat and then classified with a wind classifier to obtain toner particles 1.

The toner particles 1 had a number average particle diameter (D1) of 6.2 μm and a weight average particle diameter (D4) of 6.9 μm. By TOF-SIMS analysis of the toner particles 1, titanium phosphate-derived ions were detected.

The titanium phosphate compound is a reaction product of titanium lactate and phosphate ions derived from sodium phosphate or calcium phosphate in an aqueous medium.

Toner particles 1 were used as toner 1 as they were.

Toner 2

Toner particles 2 were obtained in the same manner as in the production example of toner 1, except that 4.3 parts of a 44% aqueous solution of titanium lactate (TC-310: manufactured by Matsumoto Fine Chemical Co., Ltd.) in the production example of toner 1 was changed to 3.2 parts (equivalent to 1.4 parts of titanium lactate). The toner particles 2 had a number average particle diameter (D1) of 6.2 μm and a weight average particle diameter (D4) of 6.9 μm.

By TOF-SIMS analysis of the toner particles 2, titanium phosphate-derived ions were detected. Toner particles 2 were used as toner 2 as they were.

Toner 3

Toner particles 3 were obtained in the same manner as in the production example of toner 1, except that 4.3 parts of a 44% aqueous solution of titanium lactate (TC-310: manufactured by Matsumoto Fine Chemical Co., Ltd.) in the production example of toner 1 was changed to 2.1 parts (equivalent to 0.9 parts of titanium lactate). The toner particles 3 had a number average particle diameter (D1) of 6.2 μm and a weight average particle diameter (D4) of 6.9 μm.

By TOF-SIMS analysis of the toner particles 3, titanium phosphate-derived ions were detected. Toner particles 3 were used as toner 3 as they were.

Toner 4

Toner particles 4 were obtained in the same manner as in the production example of toner 1, except that 4.3 parts of a 44% aqueous solution of titanium lactate (TC-310: manufactured by Matsumoto Fine Chemical Co., Ltd.) in the production example of toner 1 was changed to 11.7 parts of zirconium lactate ammonium salt (ZC-300, Matsumoto Fine Chemical Co., Ltd.) (equivalent to 1.4 parts of zirconium lactate ammonium salt). The toner particles 4 had a number average particle diameter (D1) of 6.2 μm and a weight average particle diameter (D4) of 6.9 μm.

By TOF-SIMS analysis of the toner particles 4, zirconium phosphate-derived ions were detected. The zirconium phosphate compound is a reaction product of a zirconium lactate ammonium salt and a phosphate ion derived from sodium phosphate or calcium phosphate in an aqueous medium.

Toner particles 4 were used as toner 4 as they were.

Toner 5

The following sample was weighed in a reaction vessel and mixed using a propeller stirring blade.

Toner base particle-dispersed solution: 500.0 parts

Next, while maintaining the temperature at 25° C., the pH was adjusted to 1.5 with 1.0 mol/L hydrochloric acid, the mixture was stirred for 1.0 h, and then filtered while being washed with ion exchanged water. The obtained powder was dried in a thermostat and then classified with a wind classifier to obtain toner particles 5.

Toner particles 5: 100.0 parts

Hydrophobic silica fine particles (hexamethyldisilazane treatment: number average particle diameter 12 nm): 1.0 part Zirconium phosphate compound fine particles: 1.5 parts The above materials were put into SUPERMIXER PICCOLO SMP-2 (manufactured by Kawata Co., Ltd.) and mixed at 3000 rpm for 20 min. Then, the mixture was sieved with a mesh having openings of 150 μm to obtain a toner 5. The toner 5 had a number average particle diameter (D1) of 6.2 μm and a weight average particle diameter (D4) of 6.9 μm.

When TOF-SIMS analysis of the toner 5 was performed, ions derived from zirconium phosphate were detected.

Toner 6

In the production example of toner 5, 1.5 parts of titanium oxide fine particles having a number average particle diameter of 28 nm were used in place of the zirconium phosphate compound fine particles, the components were charged into SUPERMIXER PICCOLO SMP-2 (manufactured by Kawata Co., Ltd.) and mixing was performed at 3000 rpm for 20 min. Then, the toner was sieved with a mesh having openings of 150 μm to obtain a toner 6. When TOF-SIMS analysis of the toner 6 was performed, no ion derived from the polyvalent acid metal salt was detected.

Table 1 shows the physical properties of the obtained toners 1 to 6.

TABLE 1

| | Reaction product of polyvalent acid and compound including Group 4 element | Organosil icon polymer | M1(at %) | M2/M1 |
|---|---|---|---|---|
| Toner 1 | Titanium phosphate | Y | 4.70% | 0.99 |
| Toner 2 | Titanium phosphate | Y | 3.50% | 0.99 |
| Toner 3 | Titanium phosphate | Y | 2.30% | 0.99 |
| Toner 4 | Zirconium phosphate | Y | 3.50% | 0.99 |
| Toner 5 | Zirconium phosphate | N | 4.20% | 0.5 |
| Toner 6 | None (titanium oxide) | N | — | — |

In the table, the column of organosilicon polymer represents the presence or absence of an organosilicon polymer on the toner surface determined by TEM-EDX observation, Y indicates that the organosilicon polymer is present, and N indicates that the organosilicon polymer is not present.

Confirmation of Toner Effect

1. Electric Resistance Characteristic

First, in order to confirm the characteristics of the toner, the toner 1 and the toner 6 were evaluated using LBP7600C manufactured by Canon Inc. as an image forming apparatus and using Vitality Multipurpose Paper, Letter size (basis weight 75 g/m$^2$, manufactured by Xerox Corporation) as a recording material. A solid black image (20 cm×27 cm) having a toner laid-on level of 0.4 mg/cm$^2$ was formed on each recording material, and an unfixed sample and a sample after fixing were prepared. The fixing was carried out at a fixing roller surface temperature of 160° C. and a total pressure of 196.13 N (20 kgf).

Then, using a high resistance meter HIRESTA UPMCP-HT450 type manufactured by Dia Instruments Co., Ltd. and a measurement probe URS manufactured by the same company, the volume resistivity (Ω·cm) of the above sample was measured under the conditions of a probe pressing force of 10.8 N (1.1 kgf), an applied voltage of 100 V, and an application time of 10 sec under an environment of 23° C. and 50% RH.

The volume resistivity of the unfixed image was denoted by Tv, and the volume resistivity of the image after fixing was denoted Fv. Since the sample immediately after fixing had a large resistance variation, the measurement was performed after allowing the sample to stand in the same environment for 6 h for measurement. The measurement results are shown in Table 2.

TABLE 2

| | Volume resistivity (Ω · cm) | | |
|---|---|---|---|
| | Toner 1 | Toner 6 | Recording material |
| Tv (Unfixed) | $1 \times 10^{12}$ | $6 \times 10^{12}$ | $4 \times 10^{8}$ |
| Fv(After fixing) | $1 \times 10^{9}$ | $5 \times 10^{12}$ | $3 \times 10^{8}$ |

The volume resistivity of the toner 6 after fixing is not significantly different from that of the unfixed toner, whereas the volume resistivity of the toner 1 is clearly decreased by fixing. The results of Tv/Fv of the toners 2 to 5 measured in the same manner are shown in Table 3.

2. "Penetration" Level

Next, the effect of the toner on the "penetration" image was confirmed. The toners 1-6 were evaluated.

Figure 3A:
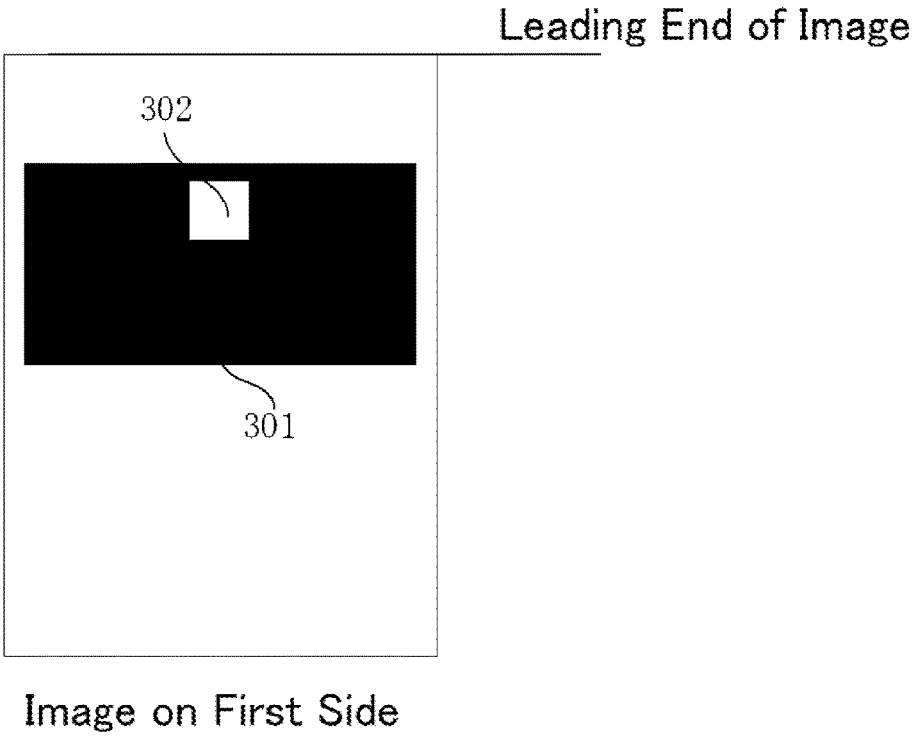
FIG. 3A to FIG. 3C show images for determining the level of a "penetration" image.
Figure 3B:
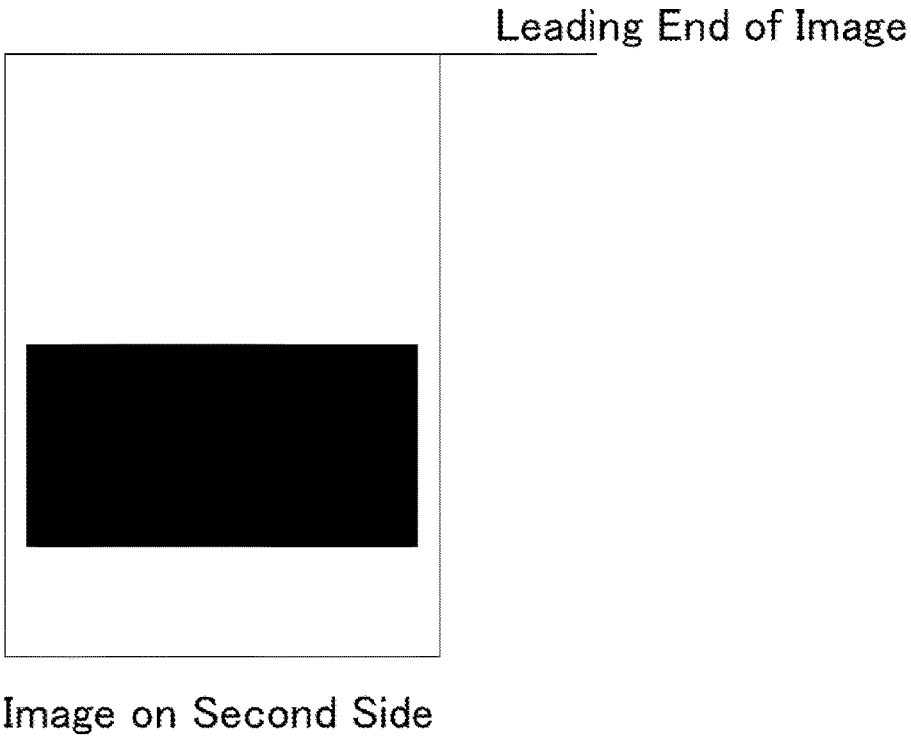
Figure 3C:
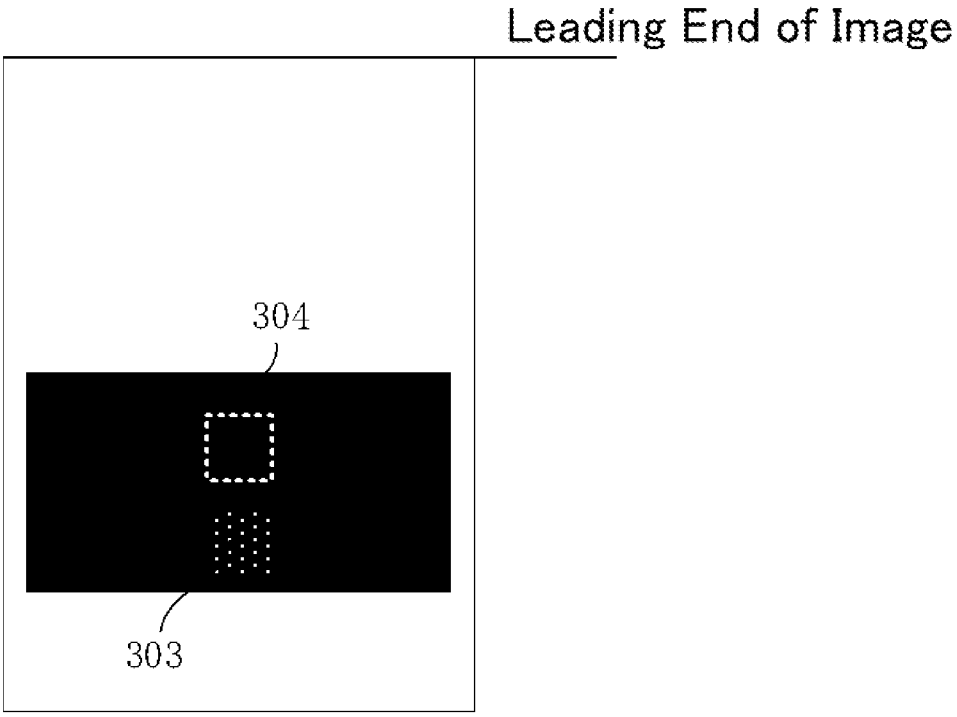
Figure 4A:
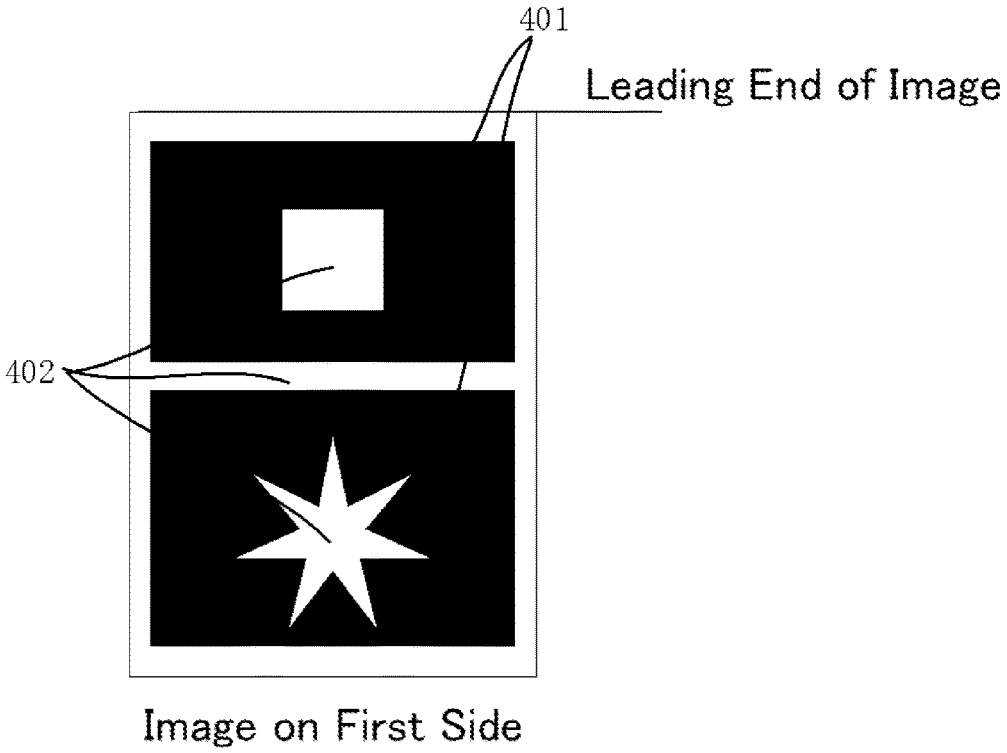
FIG. 4A to FIG. 4C are diagrams for explaining the "penetration" phenomenon.
Figure 4B:
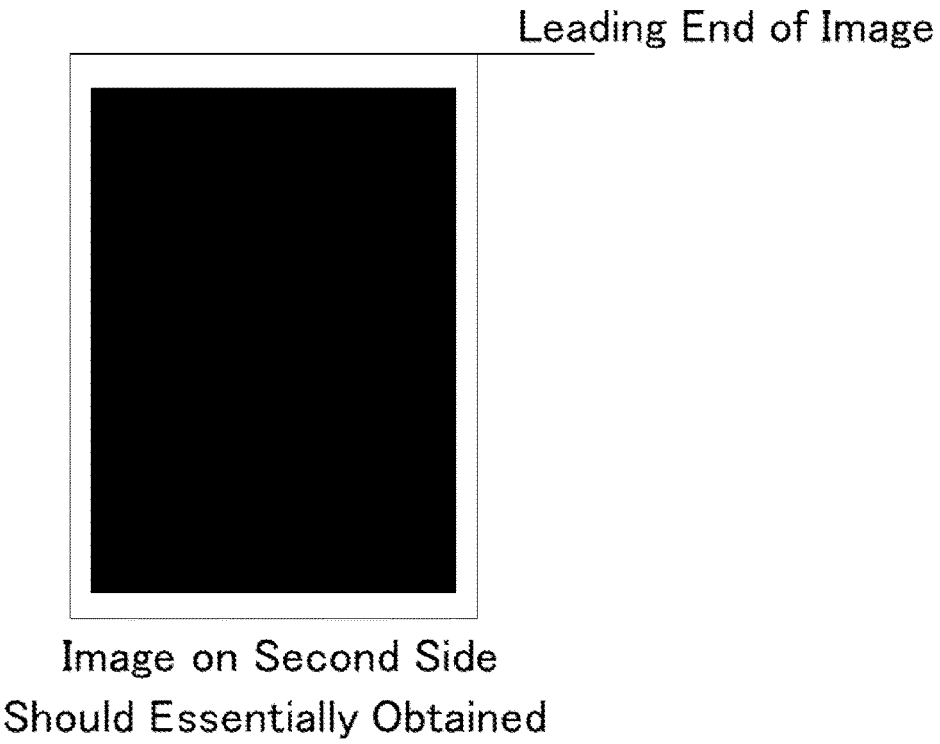
Figure 4C:
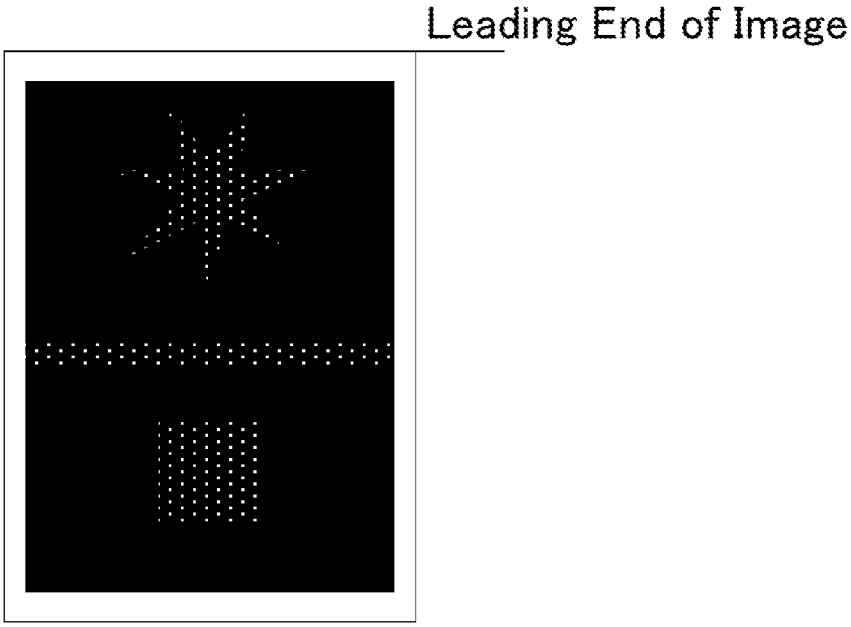

As a confirmation method, an image composed of a solid black image 301 and a solid white image 302 as shown in FIG. 3A was formed as an image on the first side, and a solid black image as shown in FIG. 3B was formed as an image on the second side. When the "penetration" occurs, it occurs in the region 303 in FIG. 3C.

Therefore, the densities of the region 303 and the other regions, for example, the white frame 304, were measured with a Densitometer 504 (manufactured by X-Rite, Inc.) under the measurement conditions of Status-A and backing white, and the density difference ΔD was used to determine the level of "penetration" according to the following ranks.

A: $\Delta D \leq 0.1$

B: $0.1 < \Delta D \leq 0.15$

C: $0.15 < \Delta D \leq 0.2$

D: $0.2 < \Delta D$

It was determined that the "penetration" could be suppressed at the ranks A, B, and C. Table 3 shows the determination results for each toner. The transfer bias indicates the average value of the transfer voltage selected by ATVC.

TABLE 3

| | | Volume resistivity Tv/Fv | Transfer bias (kV) First side | Transfer bias (kV) Second side | "Penetration" Level |
|---|---|---|---|---|---|
| Example 1 | Toner 1 | 1000 | 1.5 | 1.7 | A |
| Example 2 | Toner 2 | 500 | 1.5 | 1.9 | A |
| Example 3 | Toner 3 | 15 | 1.5 | 2.4 | B |
| Example 4 | Toner 4 | 100 | 1.5 | 2.1 | A |

TABLE 3-continued

| | | Volume resistivity Tv/Fv | Transfer bias (kV) First side | Transfer bias (kV) Second side | "Penetration" Level |
|---|---|---|---|---|---|
| Example 5 | Toner 5 | 8 | 1.5 | 2.5 | C |
| Comparative Example | Toner 6 | 1.2 | 1.5 | 2.8 | D |

The volume resistivity ratio is the ratio of the volume resistivity Tv of the unfixed image of each toner to the volume resistivity Fv of the image after fixing, which are measured by the procedure described in the Electric Resistance Characteristic section hereinabove.

It is clear that by using the toner of the present disclosure, the voltage value of the transfer bias on the second side can be lowered, so that the occurrence of "penetration" is suppressed.

The "penetration" level was correlated with the volume resistivity ratio (Tv/Fv), and when Tv/Fv was 8 or more, it was possible to obtain an image for which it was determined that the penetration could be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-137198, filed Jul. 25, 2019 which is hereby incorporated by reference herein in its entirety.

What is claimed is:

1. A toner comprising a toner particle, wherein the toner particle includes a binder resin, where a volume resistivity Ω·cm of an unfixed solid image on a recording material on which the solid image has been formed using the toner at a toner laid-on level of 0.4 mg/cm$^2$ is denoted by Tv, and a volume resistivity Ω·cm of the solid image after fixing by applying heat and pressure to the recording material is denoted by Fv, a following condition is satisfied:

$$Tv/Fv \geq 8.$$

2. The toner according to claim 1, wherein a surface of the toner particle includes a reaction product of a polyvalent acid and a compound including a Group 4 element.

3. The toner according to claim 2, wherein the reaction product of the polyvalent acid and the compound including a Group 4 element is a polyvalent acid metal salt, and where a metal element contained in the polyvalent acid metal salt is defined as a metal element M, a ratio of the metal element M in constituent elements of a surface of the toner, which is determined from a spectrum obtained by X-ray photoelectron spectroscopy analysis of the toner, is denoted by M1 (atomic %), a toner obtained by performing a treatment (a) of dispersing 1.0 g of the toner in a mixed aqueous solution including 31.0 g of a 61.5% by mass sucrose solution and 6.0 g of a 10% by mass aqueous solution of a neutral detergent for cleaning precision measuring instruments, the 10% by mass aqueous solution containing a nonionic surfactant, an anionic surfactant and an organic builder, and shaking for 20 min at a rate of 300 cycles per 1 min by using a shaker is defined by toner (a), and a ratio of the metal element M in constituent elements of a surface of the toner (a), determined from a spectrum obtained by X-ray photoelectron spectroscopy analysis of the toner (a), is denoted by M2 (atomic %), a following formula (ME-1) is satisfied:

$$0.90 \leq M2/M1 \quad \text{(ME-1)}$$

4. The toner according to claim 2, wherein the reaction product of the polyvalent acid and the compound including a Group 4 element includes at least one selected from the group consisting of titanium sulfate, titanium carbonate, titanium phosphate, zirconium sulfate, zirconium carbonate, and zirconium phosphate.

5. The toner according to claim 1, wherein the surface of the toner particle has an organosilicon polymer.

6. The toner according to claim 5, wherein the organosilicon polymer has a structure represented by a following formula (II):

$$R—SiO_{3/2} \quad \text{(II)}$$

Where, R represents an alkyl group, an alkenyl group, an acyl group, an aryl group or a methacryloxyalkyl group.

7. The toner according to claim 6, wherein the R is an alkyl group having from 1 to 6 carbon atoms, a vinyl group, a phenyl group, or a methacryloxypropyl group.

* * * * *